United States Patent [19]

Tomaszewski et al.

[11] Patent Number: 4,466,865

[45] Date of Patent: Aug. 21, 1984

[54] TRIVALENT CHROMIUM ELECTROPLATING PROCESS

[75] Inventors: Thaddeus W. Tomaszewski, Dearborn; Robert A. Tremmel, Woodhaven; Larry T. Rudolph, Rochester, all of Mich.

[73] Assignee: OMI International Corporation, Warren, Mich.

[21] Appl. No.: 338,751

[22] Filed: Jan. 11, 1982

[51] Int. Cl.[3] ..... C25D 3/06

[52] U.S. Cl. ..... 204/51; 204/291; 204/DIG. 13

[58] Field of Search ..... 204/DIG. 13, 291, 51, 204/89, 105 R

[56] References Cited

U.S. PATENT DOCUMENTS

| | | | |
|---|---|---|---|
| 3,954,574 | 5/1976 | Gyllenspetz et al. | 204/43 T |
| 4,093,521 | 6/1978 | Renton et al. | 204/43 R |
| 4,167,460 | 9/1979 | Tomaszewski | 204/51 |

FOREIGN PATENT DOCUMENTS

| | | | |
|---|---|---|---|
| 5831 | 1/1979 | Japan | 204/291 |
| 39776 | 10/1913 | Sweden | 204/291 |

OTHER PUBLICATIONS

S. Wakabayashi et al., J. De Physique, pp. C1-241-C-1-244, Apr. 1977.

*Primary Examiner*—G. L. Kaplan

*Attorney, Agent, or Firm*—Richard P. Mueller

[57] ABSTRACT

A process for electrodepositing chromium on a conductive substrate employing an electrolyte containing trivalent chromium ions, a complexing agent, and hydrogen ions to provide an acidic pH in which a conductive substrate to be electroplated is immersed in the electrolyte and is cathodically charged and current is passed between the substrate and an anode at least a portion of the surfaces of which is comprised of ferrite whereby the formation of detrimental hexavalent chromium ions in the electrolyte is inhibited and the stability of the pH of the electrolyte is improved.

16 Claims, No Drawings

TRIVALENT CHROMIUM ELECTROPLATING PROCESS

BACKGROUND OF THE INVENTION

Chromium electroplating baths have been in widespread commercial use for many years for applying protective and decorative chromium platings to metal substrates. Heretofore, commercial chromium plating electrolytes conventionally employed hexavalent chromium ions derived by dissolving compounds such as chromic acid, for example, into the aqueous electroplating solution. The use of such hexavalent chromium electroplating electrolytes has been characterized as having limited covering power and excessive gassing particularly around apertures in the parts being plated which can result in incomplete coverage. Such prior art hexavalent chromium plating solutions are also characterized as being sensitive to current interruptions resulting in so-called "whitewashing" of the electrodeposit.

In more recent years, chromium electrolytes have been developed containing substantially all of the chromium in the trivalent state providing many advantages over the prior art hexavalent chromium electrolytes including enabling use of current densities ranging over a broad range without producing any burning of the electrodeposit; minimizing or completely eliminating the evolution of mist or noxious odors during the chromium plating process; providing for excellent coverage of the substrate and good throwing power of the electroplating bath; enabling current interruptions during the electroplating cycle without adversely affecting the chromium deposit thereby enabling parts to be withdrawn from the electrolyte, inspected, and thereafter returned to the bath for a continuation of the electroplating cycle; reducing the loss of chromium due to drag-out by virtue of employing lower concentrations of the trivalent chromium ions; and facilitating waste disposal of the chromium in effluents by virtue of simple precipitation of chromium from such aqueous effluents by the addition of alkaline substances to raise the pH to about 8 or above.

A problem associated with the commercial operation of trivalent chromium electrolytes has been the build-up of hexavalent chromium ions in the electrolyte to a level at which interference with efficient electrodeposition of chromium has been encountered as well as a reduction in the efficiency and covering power of the bath. In some instances, the progressive build-up of detrimental hexavalent chromium ions has occurred to the extent that a cessation in electrodeposition of chromium has occurred necessitating a dumping and replacement of the electrolyte.

The present invention is based on a discovery whereby efficient and continuous electrodeposition of commercially satisfactory chromium platings can be attained employing trivalent chromium electrolytes wherein the tendency to progressively build up concentrations of detrimental hexavalent chromium ions is inhibited or substantially eliminated thereby maintaining the efficiency of the operating bath. Additionally, the process of the present invention further provides for improved stability in the pH of the electrolyte during use so that analysis and periodic adjustment of the operating pH is reduced simplifying operation and control of such trivalent chromium electroplating operations.

SUMMARY OF THE INVENTION

The benefits and advantages of the present invention are based on the discovery that the use of anodes in the electroplating bath for passing current between the anode and the cathodic substrate being plated inhibits or substantially eliminates the detrimental build-up of excessive hexavalent chromium ions in the electrolyte. Additionally, the present invention is based on the discovery that a trivalent chromium electroplating solution which has become ineffective or unuseable for electrodepositing satisfactory chromium deposits because of an excessive build-up of hexavalent chromium ions therein can be rejuvenated and restored to efficient operating conditions by immersing in the electrolyte an anode of which at least a portion of the surface thereof is comprised of ferrite and passing current between the anode and the cathodic substrate for a period of time sufficient to reduce the hexavalent chromium ion concentration to permissible limits.

In addition to the foregoing discoveries, it has further been discovered that the use of ferrite anodes in trivalent chromium electroplating baths also unexpectedly improves the stability of the pH of the operating solution during use whereby less stringent monitoring and adjustment of the pH of the electrolyte is required thereby simplifying the control and operation of such chromium plating processes.

The benefits and advantages of the process of this invention is applicable to any one of a variety of trivalent chromium electrolytes containing as their essential constituents, trivalent chromium ions, a complexing agent present in an amount sufficient to maintain the trivalent chromium ions in solution, and hydrogen ions to provide an acidic pH. Such trivalent chromium electrolytes may further include any one or combinations of a variety of additional ingredients of the types known in the art to further enhance the characteristics of the chromium layer deposited.

In the practice of the present process, the electrodeposition of chromium on a conductive substrate is performed employing an aqueous acidic electrolyte at a temperature ranging from about 15° to about 45° C. and wherein the conductive substrate is cathodically charged and the anode is anodically charged and current is passed therebetween at densities ranging from about 50 to about 250 amperes per square foot (ASF). The entire anode surface may be comprised of ferrite, or alternatively, only a portion thereof may be comprised of ferrite or a plurality of anodes can be employed in combination including ferrite anodes and other insoluble anodes such as carbon (graphite) platinized titanium or platinum, for example. The conductive substrate, prior to chromium plating, is normally subjected to conventional pretreatments and preferably is provided with one or a plurality of nickel platings over which the chromium plating is applied.

Additional benefits and advantages of the present invention will become apparent upon a reading of the description of the preferred embodiments taken in conjunction with the accompanying specific examples.

DESCRIPTION OF THE PREFERRED EMBODIMENTS

The process comprising the present invention is based on the discovery that by employing ferrite as a portion or as the entire anode surface area in a trivalent chromium electrolyte, the formation of detrimental hexavalent chromium ions is inhibited or substantially eliminated further accompanied by an unexpected increase in the stability of the pH of the electrolyte over extended periods of use. The toleration of such trivalent chromium electrolytes to hexavalent chromium ion contamination varies depending upon the specific composition and concentration of the electrolyte as well as the particular parameters of electroplating employed. Detrimental effects on the chromium electrodeposit have been observed in various trivalent chromium electrolytes when the hexavalent chromium ion concentration increases to levels of about 200 up to about 500 parts per million (ppm) and higher. It is for this reason that it is desirable to maintain the level of hexavalent chromium ions in the electrolyte at a level below about 100 ppm, and preferably less than about 50 ppm. The use of an anode having all or a portion of the surface thereof composed of ferrite effectively controls hexavalent chromium ion concentration obviating the need of using various additive reducing agents for controlling the concentration of such detrimental hexavalent chromium ions.

The ferrite anode employed in the practice of the present process may be of an integral or composite construction in which the ferrite sections thereof comprise a sintered mixture of iron oxides and at least one other metal oxide to produce a sintered body having a spinnel crystalline structure. Particularly satisfactory ferrite anode materials comprise a mixture of metal oxides containing about 55 to about 90 mol percent of iron oxide calculated as $Fe_2O_3$ and at least one other metal oxide present in an amount of about 10 to 45 mol percent of metals selected from the group consisting of manganese, nickel, cobalt, copper, zinc and mixtures thereof. The sintered body is a solid solution in which the iron atoms are present in both the ferric and ferrous forms.

Such ferrite electrodes can be manufactured, for example, by forming a mixture of ferric oxide ($Fe_2O_3$) and one or a mixture of metal oxides selected from the group consisting of MnO, NiO, CoO, CuO, and ZnO to provide a concentration of about 55 to 90 mol percent of the ferric oxide and 10 to 45 mol percent of one or more of the metal oxides which are mixed in a ball mill. The blend is heated for about one to about fifteen hours in air, nitrogen or carbon dioxide at temperatures of about 700° to about 1000° C. The heating atmosphere may contain hydrogen in an amount up to about 10 percent in nitrogen gas. After cooling, the mixture is pulverized to obtain a fine powder which is thereafter formed into a shaped body of the desired configuration such as by compression molding or extrusion. The shaped body is thereafter heated at a temperature of about 1100° to about 1450° C. in nitrogen or carbon dioxide containing up to about 20 percent by volume of oxygen for a period ranging from about 1 to about 4 hours. The resultant sintered body is thereafter slowly cooled in nitrogen or carbon dioxide containing up to about 5 percent by volume of oxygen producing an electrode of the appropriate configuration characterized as having relatively low resistivity, good corrosion resistance and resistance to thermal shock.

It will be appreciated that instead of employing ferric oxide, metal iron or ferrous oxide can be used in preparing the initial blend. Additionally, instead of the other metal oxides, compounds of the metals which subsequently produce the corresponding metal oxide upon heating may alternatively be used, such as, for example, the metal carbonate or oxalate compounds. Of the foregoing, ferrite anodes comprised predominantly of iron oxide and nickel oxide within the proportions as hereinabove set forth have been found particularly satisfactory for the practice of the present process.

The benefits of the present process are attained when such ferrite anodes are employed for the electrodeposition of chromium in any one of a variety of trivalent chromium electrolytes of the types heretofore proposed or used. Such trivalent chromium electrolytes contain as their essential ingredients, trivalent chromium ions, complexing agents for maintaining the trivalent chromium ions in solution, and hydrogen ions present in an amount to provide an acidic pH. The trivalent chromium ions may broadly range from about 0.2 to about 0.8 molar, and preferably from about 0.4 to about 0.6 molar. Concentrations of trivalent chromium below about 0.2 molar have been found to provide poor throwing power and poor coverage in some instances whereas, concentrations in excess of about 0.8 molar have in some instances resulted in precipitation of the chromium constituent in the form of complex compounds. The trivalent chromium ions can be introduced in the form of any simple aqueous soluble and compatible salt such as chromium chloride hexahydrate, chromium sulfate, and the like. Preferably, the chromium ions are introduced as chromium sulfate for economic considerations.

The complexing agent employed for maintaining the chromium ions in solution should be sufficiently stable and bound to the chromium ions to permit electrodeposition thereof as well as to allow precipitation of the chromium during waste treatment of the effluents. The complexing agent may comprise formate ions, acetate ions or mixtures of the two of which the formate ion is preferred. The complexing agent can be employed in concentrations ranging from about 0.2 up to about 2.4 molar as a function of the trivalent chromium ions present. The complexing agent is normally employed in a molar ratio of complexing agent to chromium ions of from about 1:1 up to about 3:1 with ratios of about 1.5:1 to about 2:1 being preferred. Excessive amounts of the complexing agent such as formate ions is undesirable since such excesses have been found in some instances to cause precipitation of the chromium constituent as complex compounds.

In as much as the trivalent chromium salts and complexing agent do not provide adequate bath conductivity by themselves, it is preferred to further incorporate in the electrolyte controlled amounts of conductivity salts which typically comprise salts of alkali metal or alkaline earth metals and strong acids such as hydrochloric acid and sulfuric acid. The inclusion of such conductivity salts is well known in the art and their use minimizes power dissipation during the electroplating operation. Typical conductivity salts include potassium and sodium sulfates and clorides as well as ammonium chloride and ammonium sulfate. A particularly satisfactory conductivity salt is fluoboric acid and the alkali metal, alkaline earth metal and ammonium bath soluble fluoborate salts which introduce the fluoborate ion in the bath and which has been found to further enhance the chromium deposit. Such fluoborate additives are preferably employed to provide a fluoborate ion concentration of from about 4 to about 300 g/l. It is also typical to employ the metal salts of sulfamic and methane sulfonic acid as a conductivity salt either alone or in combination with inorganic conductivity salts. Such conductivity salts or mixtures thereof are usually employed in amounts up to about 300 g/l or higher to achieve the requisite electrolyte conductivity and optimum chromium deposition.

It has also been recognized that ammonium ions in the electrolyte are beneficial in enhancing the electrodeposition of chromium. Particularly satisfactory results are achieved at molar ratios of total ammonium ion to chromium ion ranging from about 2:1 up to about 11:1, and preferably, from about 3:1 to about 7:1. The ammonium ions can in part be introduced as the ammonium salt of the complexing agent such as ammonium formate, for example, as well as in the form of supplemental conductivity salts.

The presence of halide ions in the bath of which chloride and bromide ions are preferred is also beneficial for the electrodeposition of chromium. The use of a combination of chloride and bromide ions also inhibits the evolution of chlorine at the anode. While iodine can also be employed as the halide constituent, its relatively higher cost and low solubility render it less desirable than chloride and bromide. The halide concentration is controlled in relationship to the chromium concentration present and is controlled at a molar ratio of up to about 10:1 halide to chromium, with a molar ratio of about 2:1 to about 4:1 being preferred.

In addition to the foregoing constituents, the bath optionally but preferably also contains a buffering agent in an amount of about 0.15 molar up to bath solubility, with amounts typically ranging up to about 1 molar. Preferably the concentration of the buffering agent is controlled from about 0.45 to about 0.75 molar calculated as boric acid. The use of boric acid as well as the alkali metal and ammonium salts thereof as the buffering agent also is effective to introduce borate ions in the electrolyte which have been found to improve the covering power of the electrolyte. In accordance with a preferred practice, the borate ion concentration in the bath is controlled at a level of at least about 10 g/l. The upper level is not critical and concentrations as high as 60 g/l or higher can be employed without any apparent harmful effect.

The bath further incorporates as an optional but preferred constituent, a wetting agent or mixture of wetting agents of any of the types conventionally employed in nickel and hexavalent chromium electrolytes. Such wetting agents or surfactants may be anionic or cationic and are selected from those which are compatible with the electrolyte and which do not adversely affect the electrodeposition performance of the chromium constituent. Typically, wetting agents which can be satisfactorily employed include sulphosuccinates or sodium lauryl sulfate and alkyl ether sulfates alone or in combination with other compatible anti-foaming agents such as octyl alcohol, for example. The presence of such wetting agents has been found to produce a clear chromium deposit eliminating dark mottled deposits and providing for improved coverage in low current density areas. While relatively high concentrations of such wetting agents are not particularly harmful, concentrations greater than about 1 gram per liter have been found in some instances to produce a hazy deposit. Accordingly, the wetting agent when employed is usually controlled at concentrations less than about 1 g/l, with amounts of about 0.05 to about 0.1 g/l being typical.

It is also contemplated that the electrolyte can contain other metals including iron, manganese, and the like in concentrations of from 0 up to saturation or at levels below saturation at which no adverse effect on the electrolyte occurs in such instances in which it is desired to deposit chromium alloy platings. When iron is employed, it is usually preferred to maintain the concentration of iron at levels below about 0.5 g/l.

The electrolyte further contains a hydrogen ion concentration sufficient to render the electrolyte acidic. The concentration of the hydrogen ion is broadly controlled to provide a pH of from about 2.5 up to about 5.5 while a pH range of about 3 to 3.5 is particularly satisfactory. The initial adjustment of the electrolyte to within the desired pH range can be achieved by the addition of any suitable acid or base compatible with the bath constituents of which hydrochloric or sulfuric acid and/or ammonium or sodium carbonate or hydroxide are preferred. During the use of the plating solution, the electrolyte has a tendency to become more acidic and appropriate pH adjustments are effected by the addition of alkali metal and ammonium hydroxides and carbonates of which the ammonium salts are preferred in that they simultaneously replenish the ammonium constituent in the bath.

In addition to the foregoing electrolyte compositions, beneficial results are also obtained in accordance with the practice of the present invention on electrolytes as generally and specifically described in U.S. Pat. Nos. 3,954,574; 4,107,004; 4,169,022 and 4,196,063, the teachings of which are incorporated herein by reference.

In accordance with the practice of the present process an electrolyte of any of the compositions as hereinabove described is employed at an operating temperature usually ranging from about 15° to about 45° C., preferably about 20° to about 35° C. Current densities during electroplating can range from about 50 to 250 ASF with densities of about 75 to about 125 ASF being more typical. The electrolyte can be employed to plate chromium on conventional ferrous or nickel substrates and on stainless steel as well as nonferrous substrates such as aluminum and zinc. The electrolyte can also be employed for chromium plating plastic substrates which have been subjected to a suitable pretreatment according to well-known techniques to provide an electrically conductive coating thereover such as a nickel or copper layer. Such plastics include ABS, polyolefin, PVC, and phenol-formaldehyde polymers. The work pieces to be plated are subjected to conventional pretreatments in accordance with prior art practices and the process is particularly effective to deposit chromium platings on conductive substrates which have been subjected to a prior nickel plating operation.

In the practice of the present process, a conductive substrate or work piece to be chromium plated is immersed in the electrolyte and is cathodically charged. One or a plurality of anodes are immersed in the electrolyte of which at least a portion of the surface or surfaces thereof are comprised of the ferrite material and current is passed between the anode and conductive work piece for a period of time sufficient to deposit a chromium electroplate on the substrate of the desired chracteristics and thickness. While the anode or plurality of anodes may be entirely comprised of the ferrite material, it is also contemplated, particularly when employing a plurality of anodes, that a portion of such anode surfaces may be comprised of alternative suitable materials which will not adversely affect the treating solution and which is compatible with the electrolyte composition. For this purpose such other anodes employed in combination with the ferrite anodes may be comprised of inert materials such as carbon (graphite), platinized titanium, platinum and the like. When a chromium-iron alloy is to be electrodeposited, a portion of the anodes may suitably be comprised of iron which itself will dissolve and serve as a source of the iron ions in the bath.

The ratio of the anode surface area to the cathode surface area is not critical and is usually based on considerations of anode costs, space in the plating tank, and the desired cathode current density for a particular part configuration. Generally, anode to cathode ratios may range between about 4:1 to about 1:1 with ratios of about 2:1 being typical and preferred.

In accordance with a further aspect of the process of the present invention, a rejuvenation of a trivalent chromium electrolyte which has been rendered ineffective or inoperative due to the high concentration of hexavalent chromium ions accumulated during use is achieved by the immersion of a ferrite anode or plurality of anodes for the conventional insoluble anodes employed in the electroplating tank. The rejuvenation treatment utilizes an electrolytic treatment of the contaminated electrolyte following the substitution with ferrite anodes usually by subjecting the electrolyte to a low current density of about 10 to about 30 ASF for a period of time to effect a conditioning or so-called "dummying" of the electrolyte to effect a progressive reduction in the concentration of hexavalent chromium ions before commercial plating operations are resumed. The rejuvenation treatment is continued until the hexavalent chromium ion concentration is reduced below about 100 ppm and preferably below about 50 ppm. The duration of such rejuvenation treatment will vary depending upon the composition of the electrolyte as well as the concentration of hexavalent chromium ions initially present. Generally, periods of about 30 minutes up to about 24 hours are satisfactory. At the conclusion of the rejuvenation treatment it is normally necessary to replenish and adjust other constituents in the electrolyte to within the desired concentrations in order to achieve optimum plating performance.

In order to further illustrate the process of the present invention, the following specific examples are provided. It will be understood that the examples as hereinafter set forth are provided for illustrative purposes and are not intended to be limiting of the invention as herein disclosed and as set forth in the subjoined claims.

EXAMPLE 1

A trivalent chromium electrolyte is prepared by dissolving in water the following ingredients:

| Ingredient | Amount, g/l |
|---|---|
| $Cr^{+3}$ | 26 |
| $NH_4OOCH$ | 40 |
| $H_3BO_3$ | 50 |
| $NH_4Cl$ | 90 |
| $NaBF_4$ | 110 |
| Wetting Agent | 0.1 |

The wetting agent or surfactant employed in the foregoing electrolyte comprises a mixture of dihexyl ester of sodium sulfo succinic acid and sodium sulfate derivative of 2-ethyl-1-hexanol. The trivalent chromium ions are introduced by way of chromium sulfate.

A ferrite anode comprising a sintered mixture of iron oxide and nickel oxide commercially available from TDK, Inc. under the designation F-21 and of a total original weight 781 grams is immersed in the electrolyte. A cathode is immersed in the electrolyte and current is passed between the anode and cathode at a cathode current density of about 30 ASF for a period of 6 hours, 24 hours, and 32 hours. At the completion of each time interval, the ferrite anode is removed and weighed and no weight loss is incurred. The ferrite anode is allowed to stand immersed in the electrolyte for a period of 2 days and is again weighed evidencing no weight loss. These tests clearly evidence the excellent resistance to corrosion of such ferrite anodes in trivalent chromium electrolytes.

The foregoing electrolyte containing the ferrite anode is operated at an anode to cathode surface area ratio of about 2:1 at a temperature of 80° F. and at a cathode current density of about 30 ASF for a period of 18 hours. The initial pH of the electrolyte is about 4 and at the conclusion of the 18 hour dummying test, the final pH is about 3.6 evidencing a very low chlorine gas production at the anode surface. The same bath under the same operating conditions but employing a graphite anode after 18 hours dummying has a final pH of 2.2 evidencing a reduced stability in pH and a comparatively larger amount of chlorine gas produced at the anode surface.

An electrolyte of the foregoing composition is further analyzed for initial metallic contaminant concentrations and is thereafter dummied for a period of 22 hours at a temperature of 80° F., a cathode current density of 30 ASF and at an anode to cathode ratio of about 2:1 employing the ferrite anode. The copper ion concentration at the conclusion of the dummying test period is reduced from 1.7 to 0.7 mg/l; the iron concentration is reduced from 189 to 50 mg/l; the lead ion concentration is reduced from an initial level of 3.6 to 0.9 mg/l; the nickel ion concentration is reduced from 37.9 to 31.8 mg/l and the zinc ion concentration is reduced from an initial content of 1.7 to a final content of 1.1 mg/l.

EXAMPLE 2

A trivalent chromium electrolyte is prepared having a composition identical to the electrolyte as described in Example 1 with the exception that 45 g/l of boric acid and 25 g/l of trivalent chromium ions are in solution. The electrolyte has a pH of 4.2 and is operated at a temperature of 80° F. at a cathode current density of 100 ASF with a ferrite anode to cathode ratio of about 2:1.

Electrodeposition of chromium on a nickel plated cathode is initiated and the presence of chromium ions in the electrolyte is checked after initiation of plating at total plating times of 10 minutes, 20 minutes, 30 minutes and 90 minutes. No hexavalent chromium ions are detected at the completion of this stage of the test. The electrolyte is further employed at a cathode current density of 30 ASF for a total time of 17 hours after which no evidence of hexavalent chromium ion presence is detected.

EXAMPLE 3

A trivalent chromium electrolyte is prepared identical to that described in Example 2 with the exception that 75 g/l of potassium chloride is employed in place of 110 g/l of $NaBF_4$. The electrolyte has an initial pH of 4.0 and is operated at a temperature of 80° F. at a cathode current density of 100 ASF. A ferrite anode as described in Example 1 is immersed in the electrolyte bath and a nickel plated cathode is employed to provide an anode to cathode ratio of 2:1.

The cathode is electroplated with chromium under the foregoing process parameters and the presence of hexavalent chromium ions in the electrolyte is periodically checked. At the completion of 4½ hours plating, no hexavalent chromium ions are detected. The cathode is plated for an additional 17 hour period at 30 ASF after which the electrolyte is analyzed and no presence of hexavalent chromium ions is found.

EXAMPLE 4

A trivalent chromium electrolyte is prepared identical to that described in Example 2 with the exception that 145 g/l of sodium sulfate is employed in lieu of 110 g/l of $NaBF_4$. The electrolyte has an initial pH of 4.1 and is operated at a temperature of 78° F. at a cathode current density of 100 ASF employing the ferrite anode of Example 1 and a nickel plated cathode at an anode to cathode ratio of 2:1.

The cathode is electroplated for a total time of 240 minutes and the electrolyte is periodically checked during the electroplating process and no hexavalent chromium ions are detected at such intervals and at the conclusion of the plating period.

EXAMPLE 5

The ability to rejuvenate a trivalent chromium electrolyte which has become contaminated with hexavalent chromium ions is demonstrated in this example employing the electrolyte as described in Example 1 to which hexavalent chromium ions are added in the form of chromic acid at three different levels, namely 25 mg/l, 50 mg/l and 100 mg/l calculated as $Cr^{+6}$. The electroplating tank containing the electrolyte is equipped with a nickel plated cathode and the ferrite anode of Example 1 providing an anode to cathode ratio of 2:1 and the bath is operated at a cathode current density of 100 ASF at a temperature of 80° F. During each of these three tests, 1 milliliter samples of the electrolyte are withdrawn after every 5 minute interval of plating and are checked by using diphenyl carbohydrazide to detect the presence of hexavalent chromium ions by a distinct red coloration of the sample.

The electrolyte initially containing 25 mg/l hexavalent chromium ions required a plating duration under the plating parameters as hereinabove set forth of 10 minutes to eliminate the hexavalent chromium ions. The electrolyte initially containing 50 mg/l hexavalent chromium ions required a plating duration of 20 minutes to eliminate such contamination while the electrolyte containing an initial 100 mg/l hexavalent chromium ions required a total plating time of 40 minutes until no hexavalent chromium ions could be detected in the 1 milliliter test samples withdrawn.

EXAMPLE 6

An electroplating bath is prepared employing an electrolyte of the composition as described in Example 1 employing a combination of graphite and ferrite anodes. The graphite anode had a total surface area of 64 square inches while the ferrite anode had a total surface area of 11 square inches providing a ferrite anode surface of about 15 percent of the total anode surface. A test panel is electroplated at a cathode current density of 100 ASF at an electrolyte temperature of about 80° F. for a period of about one-half hour after which the electrolyte is checked for the presence of any hexavalent chromium ions in accordance with the technique as previously described in Example 5. No detectable concentration of hexavalent chromium ions occurred.

A portion of the ferrite anode surface is masked with a 3M electroplating tape of the type conventionally employed for masking surfaces to reduce the percentage of ferrite anode surface to about 13 percent of the total anode surface. Electroplating of a test panel was resumed under the conditions previously set forth and hexavalent chromium ion formation was detected during the period of 15 minutes up to one-half hour following the initiation of plating. The masking tape was thereafter removed to restore the ferrite anode surface area to 15 percent and plating was again resumed with the hexavalent chromium ion concentration being periodically monitored. The hexavalent chromium ion concentration slowly decreased and was no longer detectable after about one-half hour of plating.

It is apparent from this test under the specific conditions employed and with the particular electrolyte used, that satisfactory trivalent chromium plating can be achieved without adverse formation of hexavalent chromium ions when the ferrite anode surface area comprises at least about 15 percent of the total anode surface area at an anode to cathode ratio of about 2:1. The particular percentage of anode surface area comprised of ferrite can accordingly be adjusted to prevent hexavalent chromium ion formation by experimental tests for alternative trivalent chromium electrolyte compositions and bath operating parameters in such instances where a combination of anodes are employed.

EXAMPLE 7

A trivalent chromium electrolyte is prepared by dissolving in water the following ingredients:

| Ingredient | Amount, g/l |
|---|---|
| $Cr^{+3}$ | 26 |
| $NH_4OOCH$ | 40 |
| $H_3BO_3$ | 50 |
| $NH_4Cl$ | 150 |
| $NaBF_4$ | 55 |
| Wetting Agent | 0.1 |

The wetting agent is the same as that employed in the electrolyte of Example 1 and the pH of the electrolyte is adjusted to about 3 to 3.5. The electrolyte is controlled at a temperature of about 75° to 80° F. and a ferrite anode of the type described in Example 1 is immersed in the electrolyte and a nickel plated cathode is employed to provide an anode to cathode ratio of 2:1 and a current density of 100 ASF.

The cathode is electroplated with chromium in accordance with the foregoing process parameters and no hexavalent chromium ions are detected in the electrolyte under the conditions and with results similar to those described in connection with Example 3.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A process for electrodepositing chromium on a conductive substrate from a trivalent chromium electrolyte in a manner to inhibit formation of detrimental hexavalent chromium ions in the electrolyte which comprises the steps of providing a bath composed of an aqueous acidic electrolyte containing trivalent chromium ions and a complexing agent, immersing an anode in said bath at least a portion of the surface of which is comprised of ferrite, immersing a substrate to be electroplated in said bath, anodically electrifying said anode and cathodically electrifying said substrate, passing current through said bath between said anode and said substrate to effect an electrodeposition of chromium on the substrate and continuing the passing of current until a chromium plating of the desired characteristics is deposited on the substrate.

2. The process as defined in claim 1 including the further step of controlling the temperature of said bath between about 15° to about 45° C.

3. The process as defined in claim 1 including the further step of controlling the temperature of said bath between about 20° to about 35° C.

4. The process as defined in claim 1 including the further step of controlling the passing of current between said anode and said substrate at a cathode current density between about 50 to 250 ASF.

5. The process as defined in claim 1 including the further step of controlling the passing of current between said anode and said substrate at a cathode current density between about 75 to about 125 ASF.

6. The process as defined in claim 1 including the further step of controlling the anode to cathode surface area ratio between about 4:1 to about 1:1.

7. The process as defined in claim 1 including the further step of controlling the anode to cathode surface area ratio at about 2:1.

8. The process as defined in claim 1 in which substantially the entire surface of said anode comprises ferrite.

9. The process as defined in claim 1 in which said anode comprises a plurality of individual anodes of which at least one of said anodes is provided with a surface of which a portion is comprised of ferrite.

10. The process as defined in claim 1 in which at least about 15 percent of the surface of said anode is comprised of ferrite.

11. The process as defined in claim 1 including the further step of controlling the pH of said bath within a range of about 2.5 to about 5.5.

12. The process defined in claim 1 including the further step of controlling the pH of said bath within a range of about 3 to about 3.5.

13. The process as defined in claim 1 including the further step of controlling the concentration of trivalent chromium ions in the electrolyte within a range of about 0.2 to about 0.8 molar.

14. The process as defined in claim 1 including the further step of controlling the concentration of the complexing agent in the electrolyte in a molar ratio of complexing agent to chromium ions between about 1:1 to about 3:1.

15. The process as defined in claim 1 including the further steps of controlling the concentration of chromium ions in the electrolyte within a range of about 0.2 to about 0.8 molar, the concentration of the complexing agent at a molar ratio of complexing agent to chromium ions within a range of about 1:1 to about 3:1, the acidity of the electrolyte within a pH ranging from about 2.5 to about 5.5, said electrolyte further containing halide ions at a molar ratio of halide ions to chromium ions of from about 0.8:1 and to about 1.0:1, ammonium ions at a molar ratio of ammonium ions to chromium ions within a range of about 1.6:1 to about 11:1, borate ions, conductivity salts in an amount up to about 300 g/l and a wetting agent in an amount up to about 1 g/l.

16. A process of rejuvenating an aqueous acidic trivalent chromium electrolyte which has been impaired in effectiveness due to the contamination by excessive quantities of hexavalent chromium ions, said electrolyte containing trivalent chromium ions, a complexing agent for maintaining the trivalent chromium ions in solution and hydrogen ions to provide a pH on the acid side, said process comprising the steps of immersing an anode in the electrolyte at least a portion of the surface of which anode is comprised of ferrite, immersing a cathode in the electrolyte, anodically electrifying said anode and cathodically electrifying said cathode, passing current through said electrolyte between said anode and said cathode to effect an electrodeposition of chromium on the cathode and a progressive reduction in the hexavalent chromium ion content of said electrolyte and continuing the passing of current through said electrolyte until the concentration of hexavalent chromium ions is reduced to a level at which the effectiveness of the electrolyte to deposit satisfactory chromium deposits is restored.

* * * * *